US008979310B2

(12) United States Patent
Liu et al.

(10) Patent No.: US 8,979,310 B2
(45) Date of Patent: Mar. 17, 2015

(54) OMNIDIRECTIONAL LED LIGHT BULB

(75) Inventors: Shugao Liu, Shandong (CN); Jianchun An, Shandong (CN)

(73) Assignee: Shandong Kaiyuan Electronic Co., Ltd., Shandong (CN)

( * ) Notice: Subject to any disclaimer, the term of this patent is extended or adjusted under 35 U.S.C. 154(b) by 3 days.

(21) Appl. No.: 13/884,876

(22) PCT Filed: Nov. 25, 2011

(86) PCT No.: PCT/CN2011/082941
§ 371 (c)(1),
(2), (4) Date: Nov. 4, 2013

(87) PCT Pub. No.: WO2012/075891
PCT Pub. Date: Jun. 14, 2012

(65) Prior Publication Data

US 2014/0043823 A1 Feb. 13, 2014

(30) Foreign Application Priority Data

Dec. 11, 2010 (CN) ..... 2010 1 0583096

(51) Int. Cl.
*F21V 21/00* (2006.01)
*F21V 29/00* (2006.01)
(Continued)

(52) U.S. Cl.
CPC ..... *F21V 29/22* (2013.01); *F21K 9/135* (2013.01); *F21K 9/50* (2013.01); *F21V 23/006* (2013.01); *F21Y 2111/007* (2013.01); *F21Y 2101/02* (2013.01); *F21V 3/00* (2013.01)
USPC ..... 362/249.06; 362/249.02; 362/373

(58) Field of Classification Search
CPC ..... F21K 9/00; F21K 9/10; F21K 9/13; F21K 9/135; F21K 9/1355; F21Y 2101/02; F21V 29/002; F21V 29/004; F21V 29/20; F21V 29/22; F21V 29/2293
USPC ..... 362/249.02, 249.06, 294, 373, 646, 647
See application file for complete search history.

(56) References Cited

U.S. PATENT DOCUMENTS 8,021,025 B2 9/2011 Lee
2010/0213881 A1 8/2010 Imai
(Continued)

FOREIGN PATENT DOCUMENTS

CN 101598272 A 12/2009
CN 201502972 U 6/2010
(Continued)

OTHER PUBLICATIONS

International Search Report for PCT/CN2011/082941 dated Feb. 14, 2012 (published as WO/2012/075891). 4 pages.
(Continued)

*Primary Examiner* — Thomas M Sember
(74) *Attorney, Agent, or Firm* — Howard & Howard Attorneys PLLC

(57) ABSTRACT

An omnidirectional LED light bulb comprising a lamp base (1), a heat sink housing (2), a circuit board (5), an LED light source (3) and a bulb (4) is provided. The heat sink housing (2) is provided with a protruded platform (6) on which the light source (3) in a column shape of polygonal prism head is arranged. LED chips (9) are arranged on the top and lateral surfaces of the head, and an annular reflecting surface (10) is arranged on the rear portion of the head. The omnidirectional LED light bulb has the advantages of high rear light flux, omnidirectional luminescence and uniform illumination.

8 Claims, 2 Drawing Sheets

(51) Int. Cl.

| | |
|---|---|
| ***F21K 99/00*** | (2010.01) |
| ***F21V 23/00*** | (2006.01) |
| *F21Y 111/00* | (2006.01) |
| *F21Y 101/02* | (2006.01) |
| *F21V 3/00* | (2006.01) |

(56) References Cited

U.S. PATENT DOCUMENTS

| | | | | |
|---|---|---|---|---|
| 2010/0264799 | A1* | 10/2010 | Liu et al. | 313/46 |
| 2011/0001417 | A1* | 1/2011 | Stekelenburg | 313/46 |

FOREIGN PATENT DOCUMENTS

| | | | |
|---|---|---|---|
| CN | 101806406 | A | 8/2010 |
| CN | 101813255 | A | 8/2010 |
| CN | 201589090 | U | 9/2010 |
| CN | 201589111 | U | 9/2010 |
| CN | 101894765 | A | 11/2010 |
| CN | 102003647 | A | 4/2011 |
| CN | 201885028 | U | 6/2011 |

OTHER PUBLICATIONS

Energy Star Program Requirements for Integral LED Lamps Partner Commitments, Amended Mar. 22, 2010, 30 pages.
English language abstract of CN 101598272 A extracted from www.espacenet.com on Jun. 21, 2013. 2 pages.
English language abstract of CN 101806406 A extracted from www.espacenet.com on Jun. 21, 2013. 1 page.
English language abstract of CN 101813255 A extracted from www.espacenet.com on Jun. 21, 2013. 2 pages.
English language abstract of CN 101894765 A extracted from www.espacenet.com on Jun. 21, 2013. 1 page.
English language abstract of CN 102003647 A extracted from www.espacenet.com on Jun. 21, 2013. 2 pages.
English language abstract of CN 201502972 U extracted from www.espacenet.com on Jun. 21, 2013. 1 page.
English language abstract of CN 201589090 U extracted from www.espacenet.com on Jun. 21, 2013. 1 page.
English language abstract of CN 201589111 U extracted from www.espacenet.com on Jun. 21, 2013. 1 page.
English language abstract of CN 201885028 U extracted from www.espacenet.com on Jun. 21, 2013. 1 page.

* cited by examiner

OMNIDIRECTIONAL LED LIGHT BULB

CROSS REFERENCE TO RELATED APPLICATIONS

This application is a national phase of and claims priority to PCT/CN/2011/082941, filed Nov. 25, 2011, which claims priority to and the benefit of Chinese Patent Application 201010583096.0, filed Dec. 11, 2010, which is hereby incorporated by reference in its entirety.

FIELD OF INVENTION

The present invention relates to LED lighting technologies, and particularly, to an LED light bulb.

BACKGROUND OF THE INVENTION

With the rapid development of LED technologies, the LED gradually becomes a preferred new green lighting because of its advantages, such as, energy-saving, environmental protection, etc. Since incandescent and electronic energy-saving lamps still occupy a very high proportion in daily use, in order to reduce waste and use the existing interfaces, an LED light bulb using the existing interfaces was developed, for which traditional lamp base and circuit do not need to be changed. With regard to the LED light bulb for indoor lighting, the basic requirements on its luminous intensity distribution and luminance include that the light-emitting of the lamp should be omnidirectional, the luminous intensity distribution should be as uniform as possible, and the luminous flux of areas above and below the bulb should reach a set value to avoid the unevenness of light and shade which may make the user feel depressed. The suggested luminous intensity value is 100-300 cd/m$^2$ in the operating region, 100-300 cd/m$^2$ on the ceiling, and 50-150 cd/m$^2$ on the wall surface. In order to regulate the production of LED light bulb, ENERGY STAR issued a new standard of LED lighting at the end of 2009, which prescribes the luminous intensity distribution of omnidirectional LED lamp (also called as non-directional lamp). It is prescribed in the standard that products shall have an even distribution of luminous intensity (candelas) within the 0° to 135° zone (vertically axially symmetrical). Luminous intensity at any angle within this zone shall not differ from the mean luminous intensity for the entire 0° to 135° zone by more than 20%. At least 5% of total flux (lumens) must be emitted in the 135° to 180° zone. That is to say, in the zone within 270 degrees below the bulb, the luminous intensity should be large and even, and in the zone within 90 degrees above the bulb, the luminous flux should not be too small.

As it is well known, because the LED light source is packaged, an angle formed by the luminous surface is 180 degree at maximum, and its half-intensity angle is generally 140 degree at maximum. For most of the currently-used LED light bulbs, a plane type LED integrated module light source is implanted in the bulb, but the luminous surface is narrow, thus omnidirectional light-emitting can not be realized. The Chinese Patent Application No. 200920206369.2 disclosed "a lamp bulb" which may realize large light-emitting angles. However, for its complicated structure and too many contact surfaces, it is difficult to be manufactured, and not suitable for mounting a chip with large power together with poor heat dissipating effect, and short service life. The Chinese Invention Patent Application No. 201010146167.0 disclosed "an LED bulb lamp capable of improving light transmittance", wherein an LED module is fixed on an inclined plane. However, omnidirectional light-emitting of the LED bulb lamp can not be realized because the luminous flux of rear end of the bulb is lower even though the light angle is extended, and the LED bulb lamp also has disadvantages of complicated structure, difficult manufacture, unfavorable heat dissipating effect and short service life. There are other LED light bulbs adopting special lens to perform light distribution, namely that on the basis of the conventional LED lamp, an upward astigmatism lens is arranged on the surrounding LED. Although such LED light bulbs can meet the standard requirement on luminous intensity distribution, it easily brings a phenomenon of inconsistency of light color temperature and thus causes visual fatigue because of difference between light refractive indexes of different colors.

SUMMARY OF THE INVENTION

The technical problem to be solved by the present invention is to provide an omnidirectional LED light bulb with simple structure, convenient installation and favorable heat dissipating effect.

To solve the above problem, the omnidirectional LED light bulb of the present invention includes a lamp base, a heat sink housing, an LED light source, a bulb and a circuit board arranged in the cavity of the heat sink housing. And, its structural features are that the heat sink housing is provided with a protruded platform along the axial direction, the LED light source which is an integrated light source with a shape of column is arranged on the top surface of the platform and a packaging frame thereof is provided with a polygonal prism head, LED chips are arranged on the top and lateral surfaces of the head, and an annular reflecting surface is arranged on the rear portion of the head of the frame.

Preferably, the axial angle $\alpha$ between the reflecting surface and the frame is 15 degree to 35 degree.

More preferably, the axial angle $\alpha$ between the reflecting surface and the frame is 20 degree to 30 degree.

The platform is provided with a mounting hole, and the rear end of the frame is arranged in the mounting hole and connected with the protruded platform by a thread.

The head of the frame of the LED light source is in a hexagonal prism shape; LED chips are arranged on each lateral surface of the frame; and the LED chips on the top and lateral surfaces are integrally packaged by a lens.

The reflecting surface is integrated with the frame.

The heat sink housing is in a shuttle shape, and the bulb is connected to the top of the platform of the heat sink housing. An insulation material is arranged between the LED light source and the heat sink housing, and the rear end of the LED light source is provided with a fastening nut on which an electrode joint is arranged.

In the present invention, a heat sink housing is provided with a protruded platform. An LED light source is arranged on the top surface of the platform. The frame of the LED light source is in a polygonal prism shape and head thereof is the light source point. The light-emitting point is far from the rear portion of the bulb and the light blocking range is small. LED chips are arranged on the top and lateral surfaces of the head and they are integrally packaged by a lens, and a reflecting surface is arranged at the rear portion of the head. Thus, not only the luminous flux of the zone above the bulb body is high, which realizes omnidirectional light-emitting, but also the luminous intensity of the zone beside and below the bulb is uniform and the light is downy.

EMBODIMENTS OF THE INVENTION

Figure 1:
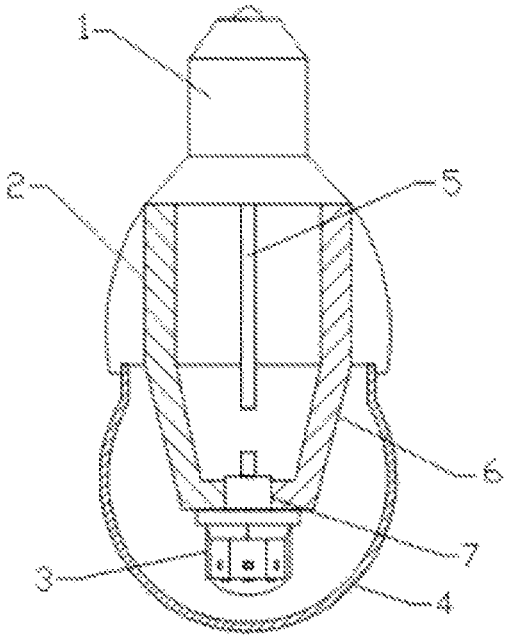
FIG. 1 is a schematic structure diagram according to an embodiment of the present invention.
Figure 2:
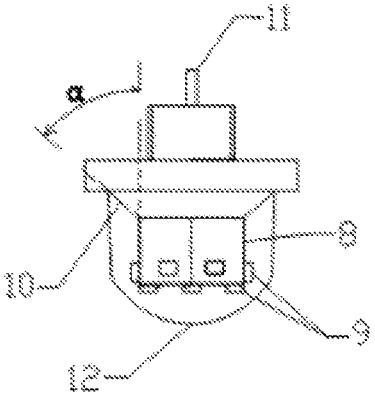
FIG. 2 is a side view of an LED light source according to the embodiment of the present invention.
Figure 3:
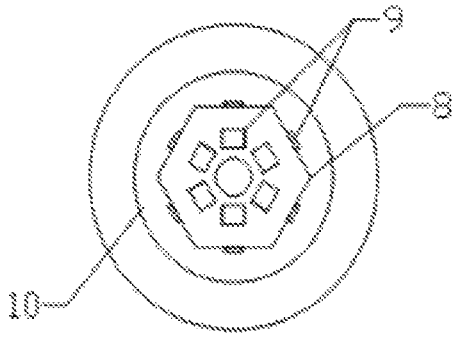
FIG. 3 is a top view of an LED light source according to the embodiment of the present invention.

As shown in FIG. 1 to FIG. 3, the present embodiment includes a lamp base 1, a heat sink housing 2, an LED light source 3, a bulb 4 and a circuit board 5 arranged in the cavity of the heat sink housing 2. The lamp base 1 is the E27 lamp base and lower part thereof is tightly connected to the heat sink housing 2 made by aluminum. Heat fins (not shown) are arranged on outside of the heat sink housing 2 provided with a protruded platform 6 along the axial direction. A mounting hole 7 is arranged in the center of the platform 6 on which the LED light source 3 is mounted. The LED light source 3 is an integrated light source with a shape of column. A packaging frame 8 of the LED light source 3 is provided with a polygonal prism head which is shown as a hexagonal prism in the figures. Optionally, according to the demands, the head may be an octagonal prism or other polygonal prisms. LED chips 9 are arranged on the top surface and each side surface of the frame 8. The walls of the platform 6 of the heat sink housing 2 are 10 mm to 30 mm in thickness preferably, to ensure the heat dissipating effect. The LED chips 9 on the top and lateral surfaces of the head are integrally packaged by a silica-gel lens 12. The rear end of the frame 8 is fitted in the mounting hole 7 of the platform 6 and connected with the platform 6 by a thread. The base of the frame 8 is tightly connected with the platform 6. A leading wire electrode 11 of the rear end of the frame 8 is electrically coupled with the circuit board 5. The structure described above makes the light-emitting point of the LED light source 3 far from the lamp base which leads to a smaller zone blocked by the heat sink at the rear end. The top and lateral surfaces of the LED light source frame are planar, so it is easy to package LED chips, and convenient to be manufactured. Meanwhile, the LED light source frame and the platform can be connected with each other tightly, and low thermal resistance, favorable heat dissipating effect and long service lifetime can be achieved. An annular reflecting surface 10 is arranged at the rear portion of the head of the frame 8, which is integrated with the frame 8. The axial angle $\alpha$ between the reflecting surface 10 and the frame 8 is 15 degree to 35 degree, preferably 20 degree to 30 degree.

Figure 4:
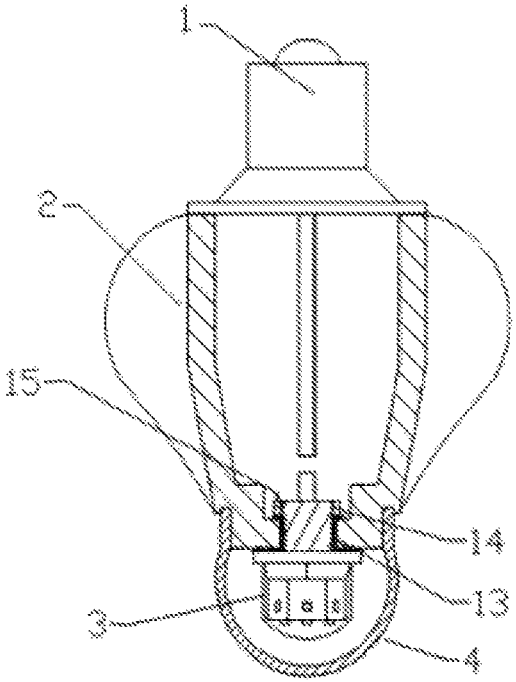
FIG. 4 is a schematic structure diagram of another embodiment according to the present invention.

In an embodiment shown in FIG. 4, the heat sink housing 2 is in a shuttle shape. The bulb 4 is connected to the top of the platform 6 of the heat sink housing 2. Only a small part of the protruded platform 6 of the heat sink housing 2 is placed in the bulb 4. The heat fins extend to the top of the platform 6, thus increasing the heat dissipating area. An insulation material 13 is arranged between the LED light source 3 and the heat sink housing 2. The rear end of the LED light source 3 is provided with a fastening nut 14 which fixes the LED light source 3 to the heat sink housing 2 and is provided with an electrode joint 15.

What is claimed is:

1. An omnidirectional LED light bulb, comprising a lamp base (1), a heat sink housing (2), an LED light source (3), a bulb (4), and a circuit board (5) arranged in a cavity of the heat sink housing (2), wherein the heat sink housing (2) is provided with a protruded platform (6) along the axial direction, the LED light source (3) which is an integrated light source with a shape of column is arranged on the top surface of the platform (6) and a packaging frame (8) thereof is provided with a polygonal prism head, LED chips (9) are arranged on the top and lateral surfaces of the head, and an annular reflecting surface (10) is arranged on the rear portion of the head of the frame (8).

2. The omnidirectional LED light bulb according to claim 1, wherein the axial angle $\alpha$ between the reflecting surface (10) and the frame (8) is 15 degree to 35 degree.

3. The omnidirectional LED light bulb according to claim 2, wherein the axial angle $\alpha$ a between the reflecting surface (10) and the frame (8) is 20 degree to 30 degree.

4. The omnidirectional LED light bulb according to claim l, wherein the platform (6) is provided with a mounting hole (7), and the rear end of the frame (8) is arranged in the mounting hole (7) and coupled with the protruded platform (6) by a thread.

5. The omnidirectional LED light bulb according to claim 4, wherein the head of the frame (8) is in a hexagonal prism shape, LED chips (9) are arranged on each lateral surface of the frame (8), and the LED chips (9) on the top and lateral surfaces are integrally packaged by a lens (12).

6. The omnidirectional LED light bulb according to claim 1, wherein the reflecting surface (10) is integrated with the frame (8).

7. The omnidirectional LED light bulb according to claim 1, wherein the heat sink housing (2) is in a shuttle shape, and the bulb (4) is connected to the top of the platform (6) of the heat sink housing.

8. The omnidirectional LED light bulb according to claim 7, wherein an insulation material (13) is arranged between the LED light source (3) and the heat sink housing (2), and the rear end of the LED light source (3) is provided with a fastening nut (14) on which an electrode joint (15) is arranged.

* * * * *